US011661704B2

(12) United States Patent
Nonni et al.

(10) Patent No.: US 11,661,704 B2
(45) Date of Patent: May 30, 2023

(54) DISSOLVING WOOD PULPS AND METHODS OF MAKING AND USING THE SAME

(71) Applicant: GP CELLULOSE GMBH, Zug (CH)

(72) Inventors: Arthur James Nonni, Peachtree City, GA (US); Charles E. Courchene, Snellville, GA (US); Harry R. Bartges, Collierville, TN (US); James M. Keough, Germantown, TN (US); William A. Howell, Mayo, FL (US); Jeremy M. Carter, Tallahassee, FL (US); Blair R. Carter, Marietta, GA (US); Christopher M. Slone, Memphis, TN (US); Philip A. Powers, Perry, FL (US); Steven T. Haywood, Tallahassee, FL (US)

(73) Assignee: GP Cellulose GmbH, Zug (CH)

( * ) Notice: Subject to any disclaimer, the term of this patent is extended or adjusted under 35 U.S.C. 154(b) by 0 days.

(21) Appl. No.: 17/388,006

(22) Filed: Jul. 29, 2021

(65) Prior Publication Data

US 2021/0355635 A1 Nov. 18, 2021

Related U.S. Application Data

(62) Division of application No. 16/284,632, filed on Feb. 25, 2019, now Pat. No. 11,105,042.

(60) Provisional application No. 62/634,727, filed on Feb. 23, 2018.

(51) Int. Cl.

| | |
|---|---|
| ***D21H 11/04*** | (2006.01) |
| ***D21C 9/10*** | (2006.01) |
| ***D21C 1/04*** | (2006.01) |
| ***D21C 3/02*** | (2006.01) |
| ***D21C 9/02*** | (2006.01) |
| ***D21C 9/14*** | (2006.01) |
| ***D21C 9/16*** | (2006.01) |
| ***D21C 1/02*** | (2006.01) |

(52) U.S. Cl.

CPC ..... *D21H 11/04* (2013.01); *D21C 1/02* (2013.01); *D21C 1/04* (2013.01); *D21C 3/02* (2013.01); *D21C 3/022* (2013.01); *D21C 9/02* (2013.01); *D21C 9/1036* (2013.01); *D21C 9/1057* (2013.01); *D21C 9/1084* (2013.01); *D21C 9/14* (2013.01); *D21C 9/163* (2013.01)

(58) Field of Classification Search

CPC ..... D21C 9/1057; D21C 1/04; D21H 11/04

See application file for complete search history.

(56) References Cited

U.S. PATENT DOCUMENTS

| | | | |
|---|---|---|---|
| 2,368,527 | A | 1/1945 | Edelstein |
| 5,223,096 | A | 6/1993 | Phan |
| 5,262,007 | A | 11/1993 | Phan |
| 5,264,082 | A | 11/1993 | Phan |
| 5,312,522 | A | 5/1994 | Van Phan |
| 5,352,332 | A | 10/1994 | Maples et al. |
| 5,415,737 | A | 5/1995 | Phan |
| 8,778,136 | B2 | 7/2014 | Nonni et al. |
| 9,511,167 | B2 | 12/2016 | Nonni et al. |
| 9,512,237 | B2 | 12/2016 | Nonni et al. |
| 9,512,563 | B2 | 12/2016 | Nonni et al. |
| 9,617,686 | B2 | 4/2017 | Nonni et al. |
| 9,719,208 | B2 | 8/2017 | Nonni et al. |
| 2006/0260773 | A1 | 11/2006 | Tan |
| 2006/0289132 | A1 | 12/2006 | Heijnesson-Hulten |
| 2013/0206349 | A1 | 8/2013 | Nonni et al. |
| 2014/0274680 | A1 | 9/2014 | Nonni et al. |
| 2015/0107789 | A1* | 4/2015 | Ni ..... D21C 5/005 162/55 |
| 2015/0184338 | A1* | 7/2015 | Luo ..... D21C 9/144 162/65 |

FOREIGN PATENT DOCUMENTS

| | | | |
|---|---|---|---|
| EP | 1068376 | A1 | 1/2001 |
| EP | 2840182 | A1 | 2/2015 |
| WO | 2010138941 | A2 | 12/2010 |
| WO | 2013106703 | A1 | 7/2013 |
| WO | 2013155190 | A1 | 10/2013 |
| WO | 2013158384 | A1 | 10/2013 |
| WO | 2014122533 | A2 | 8/2014 |
| WO | 2014140801 | A2 | 9/2014 |
| WO | 2014140852 | A2 | 9/2014 |
| WO | 2014140940 | A2 | 9/2014 |
| WO | 2015138335 | A1 | 9/2015 |
| WO | 2016130596 | A1 | 8/2016 |

(Continued)

OTHER PUBLICATIONS

International Preliminary Report on Patentability received for PCT Application No. PCT/US2019/019315, dated Sep. 3, 2020, 9 Pages.

International Search Report and Written Opinion received for PCT Application No. PCT/US2019/019315, dated Jun. 25, 2019, 11 Pages.

Ishigaki et al., "Application of surfactants for Improvement on the Viscose Processability of Sulphate Dissolving Pulp," (I), Journal of Japan Technical Association of the Pulp and Paper Industry, vol. 12, No. 88, pp. 457-461, Jul. 1958.

Peter Strunk, "Characterization of cellulose pulps and the influence of their properties on the process and production of viscose and cellulose ethers", Retrieved from Internet URL: http://www.diva-portal.org/smash/get/diva2:514909/attachment01.pdf, pp. 65-66, 2012.

(Continued)

*Primary Examiner* — Anthony Calandra

(57) ABSTRACT

This disclosure relates to methods of making novel dissolving wood pulps by processes comprising acid prehydrolysis, pulping, and a multi-stage bleaching process comprising oxidation with a catalyst and peroxide under acidic conditions, as well as to products made therefrom having a combination of medium-purity, low viscosity, and improved reactivity, filterability, and/or clogging that can be used as a substitute for traditional high-purity dissolving pulps in a wide variety of applications.

7 Claims, No Drawings

(56) References Cited

FOREIGN PATENT DOCUMENTS

| | | | |
|---|---|---|---|
| WO | 2017066499 | A1 | 4/2017 |
| WO | 2017095831 | A1 | 6/2017 |
| WO | 2017127004 | A1 | 7/2017 |
| WO | 2017210079 | A1 | 12/2017 |
| WO | 2018093697 | A1 | 5/2018 |

OTHER PUBLICATIONS

Röhrling et al.,"A Novel Method for the Determination of Carbonyl Groups in Cellulosics by Fluorescence Labeling. 2. Validation and Applications", Biomacromolecules , vol. 3, pp. 969-975, Jul. 17, 2002. (Abstract).
Smook,"Handbook for Pulp and Paper Technologists", Angus Wilde Publications, 2nd edition, chapter 11, pp. 163-185, 1992.

* cited by examiner

DISSOLVING WOOD PULPS AND METHODS OF MAKING AND USING THE SAME

RELATED APPLICATIONS

This application is a Divisional of U.S. application Ser. No. 16/284,632, filed Feb. 25, 2019, which claims priority to U.S. Provisional Application No. 62/634,727, filed Feb. 23, 2018, both of which are incorporated herein by reference in their entireties.

TECHNICAL FIELD

This disclosure relates to novel dissolving wood pulps for use in, for example, viscose fibers, yarns, and filaments. The novel dissolving wood pulps described herein have a combination of medium-purity, low viscosity, and improved reactivity, filterability, and/or clogging, and can be used as a substitute for traditional high-purity dissolving pulps in a wide variety of applications. The disclosure further relates to novel methods for making such dissolving wood pulps by a process comprising prehydrolysis prior to pulping and oxidation following pulping.

BACKGROUND

Cellulosic pulps may be used in a wide range of applications. Certain uses, such as dissolving pulps, have demanding requirements making them very expensive to produce. Dissolving pulps are those that may be dissolved into a homogeneous solution, for example by solvent or derivatization, and may then be used in the production of regenerated cellulosic materials (such as viscose, rayon, lyocell, and the like) or in the production of chemically reacted cellulose derivatives (such as cellulose ethers, cellulose esters, cellulose acetates, nitrocelluloses, and the like).

Traditionally, dissolving pulps require a combination of high alpha cellulose content, low impurity levels, good brightness, and/or a low and narrow range of degree of polymerization or viscosity. They must also demonstrate favorable properties, such as good reactivity, filtration, and/or clogging values. The starting materials and production methods needed to produce such dissolving pulps are thus very important. Cotton linter makes an exceptional cellulosic starting material for dissolving pulp, but is less abundant and more expensive than wood based cellulosic materials such as softwood or hardwood.

Where wood based cellulosic materials are used, such as softwood or hardwood, they are often processed into dissolving pulps using a chemical pulping process such as the sulfite process or the kraft process in combination with a prehydrolysis step. While prehydrolysis has the benefit of increasing alpha cellulose content, it has the undesirable effect of decreasing yield. Moreover, the more extensive the use of prehydrolysis to increase alpha cellulose content, the more expensive the process. Hardwoods are thus often preferred over softwoods in the manufacture of dissolving pulps due to their inherently lower hemicellulose content.

Where chemical pulping processes are used to manufacture dissolving pulps, further purification and/or bleaching processes may also be used following chemical pulping. Where reduction in viscosity is desired, such processes often involve treatment with hypochlorite. The use of hypochlorite, however, may be undesirable for a number of reasons, including the water and air emission issues associated with its use (i.e., chlorinated organic byproducts generally measured by AOX and TOX and chloroform, respectively).

There thus remains a need for new low-cost methods for producing dissolving wood pulps without the need for excessive-prehydrolysis or use of hypochlorite. These needs may be met by the methods described herein. Moreover, the present inventors have found that the methods described herein may be used to manufacture novel medium-purity dissolving wood pulps that may be used in place of higher cost, high-purity dissolving pulps known heretofore.

SUMMARY

This disclosure relates to methods for making dissolving wood pulps comprising subjecting a cellulosic material to an acid prehydrolysis process, subsequently subjecting the cellulosic material to a kraft cooking process to form a kraft pulp, subsequently subjecting the kraft pulp to a multi-stage bleaching process to form a kraft dissolving wood pulp, and wherein at least one stage of the multi-stage bleaching process is an oxidizing stage comprising oxidizing the pulp with at least one peroxide and at least one catalyst under acidic conditions.

This disclosure also relates to dissolving wood pulps made from a method comprising subjecting a cellulosic material to an acid prehydrolysis process, subsequently subjecting the cellulosic material to a kraft cooking process to form a kraft pulp, subsequently subjecting the kraft pulp to a multi-stage bleaching process to form a kraft dissolving wood pulp, and wherein at least one stage of the multi-stage bleaching process is an oxidizing stage comprising oxidizing the pulp with at least one peroxide and at least one catalyst under acidic conditions This disclosure also relates to kraft dissolving wood pulps comprising an R10 from about 87% to about 92%, a viscosity of from about 4 mPa·s to about 7.5 mPa·s, and a clogging value (Kr) of less than about 1000. The kraft dissolving wood pulps optionally further comprise an R18 of from about 90% to about 95%, optionally a pentosans level of from about 2% to about 5%, optionally an ISO brightness of from about 86 to about 90, optionally a carboxyl content of from about 2 meq/100 g to about 4 meq/100 g, optionally a copper number from about 0.5 to about 1.5, optionally a filterability of at least 2000 grams/min, and/or optionally a carbon disulfide reactivity of ΔT less than 10 seconds at 9 ml carbon disulfide for 14.4 g of oven dried pulp.

This disclosure also relates to products produced using the improved dissolving wood pulps, including viscose staple fibers, viscose films, and viscose filament yarns.

Additional objects and advantages of the present disclosure will be set forth in part in the description which follows. The objects and advantages of the present disclosure will further be realized and attained by means of the elements and combinations particularly pointed out in the appended claims.

DETAILED DESCRIPTION

The dissolving cellulosic pulps according to the disclosed embodiments may be derived from any common source of cellulose, including wood or cotton. As used herein, the term "cellulose" includes materials derived from any source of cellulose, which may also comprise other materials such as, for example, hemicellulose, lignin, and/or other common source materials, so long as the primary component is cellulose. In some embodiments, the cellulose may be derived from softwood, hardwood, or mixtures thereof. In some embodiments, the cellulose may be derived from hardwood, such as eucalyptus. In some embodiments, the cellulose may be derived from softwood. In some embodiments, the softwood may be southern pine.

The cellulose may be subjected to a prehydrolysis step prior to pulping. In general, chemical pulping processes alone, such as the kraft process, are not effective in removing sufficient hemicellulose for the purity required for dissolving wood pulps. Moreover, the kraft pulping process acts to stabilize hemicellulose, such that it is difficult to remove residual hemicelluloses in later processing steps following kraft pulping, such as during bleaching. Therefore, in some embodiments, a prehydrolysis step may be used prior to kraft pulping in order to remove hemicelluloses and increase the alpha cellulose content of the cellulosic material. In some embodiments, the prehydrolysis step may be carried out in a continuous digester. In some embodiments, the prehydrolysis may be carried out in a batch digester.

In some embodiments, the prehydrolysis may be conducted at an acidic pH. In some embodiments, the prehydrolysis may be an acid prehydrolysis comprising treatment of the cellulose with a catalyst, for example, sulfuric acid, sulfur dioxide, hydrochloric acid, and the like. In some embodiments, the acid prehydrolysis may be catalyzed by the addition of steam. In some embodiments, the acid prehydrolysis may be catalyzed by the addition of water, either by the direct addition of water or by allowing steam to condensate and remain in in the digester in the form of water. In such embodiments, the steam or water is believed to act to liberate naturally occurring acids within the cellulosic material that act as catalysts to effect autohydrolysis.

The severity of the prehydrolysis may be controlled by adjusting the time and temperature conditions. The temperature may range from about 140 to about 190° C., for example, from about 150 to about 180° C. The time may be from about 15 to about 150 min, for example, from about 30 to about 120 min, or from about 60 to about 90 min. The severity of the prehydrolysis process may be evaluated by the time and temperature of the process and may be expressed in "Pr units." In some embodiments, the prehydrolysis stage may comprise from 1500 to 9000 Pr units, for example, from about 3000 to about 5000 Pr units, or from about 3500 to about 4500 Pr units. Pr units may be calculated using the equation below, where T is in degrees Celsius and t is in minutes:

$$Pr = \int_0^t \frac{3^{(T-100)/10}}{30}$$

The severity of the prehydrolysis process may be adjusted in order to ensure target values of the final dissolving pulp, for example, K number, R18, R10, ΔR, hemicellulose pentosans, and the like.

The cellulose according to the present invention may be subjected to a chemical cooking process to form a cellulose pulp, for example, a sulfite or sulfate (kraft) pulping process. In some embodiments, the cellulose may be subjected to acid prehydrolysis followed by a kraft pulping process.

In the standard kraft process, a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking," "pulping," or "digesting." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood. The effective alkali of the white liquor charge may be at least about 16%, for example, at least about 17%, or at least about 18%.

The severity of the kraft pulping process may be controlled by adjusting the time and temperature conditions to achieve a desired k number at the end of the kraft process. Generally, the temperature of the wood/liquor mixture in the digester is maintained at about 145° C. to 175° C. for a total reaction time of about 1-3 hours. In some embodiments, the digestion may be carried out at a temperature between about 160° C. to about 170° C. In some embodiments, the time may be from about 60 to about 150 min, for example, from about 90 to about 120 min. The severity of kraft pulping may be evaluated by the time and temperature of the process and may be expressed in "H units." In some embodiments, the kraft process may comprise from about 1000 to about 4000 H units, for example, from about 1500 to about 2500 H units, or from about 1800 to about 2200 H units. H units may be calculated using the equation below, where T is in Celsius and t is in minutes:

$$H = \int_0^t \frac{e^{\left[43.2-\frac{16113}{T+273}\right]}}{30}$$

K number (permanganate number) is determined according to Tappi T214 and may be used as an approximation for the amount of residual lignin in the pulp. In some embodiments, the kraft process may be conducted until the cellulosic material reaches a target K number from about 12 to about 22, for example, from about 15 to about 18.

When the kraft process is complete, the resulting kraft pulp may be separated from the spent liquor (black liquor) which includes the used chemicals and dissolved lignin. Conventionally, the black liquor is burnt in a kraft recovery process to recover the sodium and sulphur chemicals for reuse. At this stage, the kraft pulp exhibits a characteristic brownish color due to lignin residues that remain on the cellulose fiber. In some embodiments, the kraft pulp may be further washed, de-knotted, and/or screened at the end of the kraft cooking process.

In some embodiments, the cellulose pulp may be subjected to an oxygen delignification process. This oxygen delignification process generally further reduces the lignin content and improves the effectiveness of any subsequent bleaching sequence. Oxygen delignification can be performed by any method known to those of ordinary skill in the art. For instance, oxygen delignification may be a conventional two-stage oxygen delignification. In some embodiments, the cellulose pulp is not further subjected to oxygen delignification after pulping. In some embodiments, the cellulose pulp is subject to oxygen delignification after kraft pulping. In some embodiments, the cellulose is subject to acid prehydrolysis, followed by kraft pulping, followed by oxygen delignification.

In embodiments comprising oxygen delignification, the cellulose pulp may be subjected to oxygen delignification until it reaches a target K number of from about 3 to about 12, for example, from about 3 to about 8 or from about 8 to about 12. In some embodiments, including those comprising both oxygen delignification and a multi-stage bleaching process comprising a Dn stage, the target K number may be from about 3 to about 8.

In embodiments comprising oxygen delignification, the oxygen delignification may comprise addition of from about 20 to about 80 lbs/ton of NaOH. In some embodiments, the amount of NaOH added during oxygen delignification may be used to help control the viscosity of the final product, with higher amounts of NaOH generally leading to a lower viscosity. For example, where higher viscosities are desired, from about 20 to about 35 lbs/ton NaOH may be added during oxygen delignification. Where lower viscosities are desired, from about 35 to about 80 lbs/ton NaOH may be added during oxygen delignification. For example, in some embodiments comprising both oxygen delignification and a multi-stage bleaching process comprising a Dn stage where a viscosity of greater than about 6.5 mPa·s is desired, from about 20 to about 35 lbs/ton NaOH may be added during oxygen delignification. In some embodiments comprising both oxygen delignification and a multi-stage bleaching process comprising a Dn stage where a viscosity of less than about 6.5 mPa·s is desired, from about 35 to about 80 lbs/ton NaOH may be added during oxygen delignification.

In some embodiments, the cellulose pulp may be subjected to a bleaching (purification) process. Bleaching of wood pulp is generally conducted with the aim of selectively increasing the whiteness and/or brightness of the pulp, typically by removing lignin and other impurities, without negatively affecting other physical properties. Bleaching of chemical pulps, such as Kraft pulps, generally requires several different bleaching stages to achieve a desired whiteness and/or brightness with good selectivity. Traditionally, bleaching sequences employ stages conducted at alternating pH ranges. This alternation is believed to aid in the removal of impurities generated in the bleaching sequence, for example, by solubilizing the products of lignin breakdown. In some embodiments, the cellulose is subject to acid prehydrolysis, followed by kraft pulping, followed by oxygen delignification, followed by bleaching.

The cellulose may be subjected to any known bleaching processes, including any conventional or after-discovered series of stages conducted under conventional conditions. In some embodiments, each stage of the multi-stage bleaching sequence may comprise at least a reactor and a washer. In some embodiments, the multi-stage bleaching sequence may be a three-, four-, five-, six-, or seven-stage bleaching sequence. In some embodiments, the multi-stage bleaching sequence may be a four-stage bleaching sequence. In some embodiments, the multi-stage bleaching sequence may be a five-stage bleaching sequence. In some embodiments, particularly those comprising at least one cold caustic extraction stage and/or at least one acid sour stage, the multi-stage bleaching sequence may be a six- or seven-stage bleaching sequence.

In some embodiments, the cellulose pulp (including any hemicellulose portion) may be subjected to an oxidation treatment. Cellulose exists generally as a polymer chain comprising hundreds to tens of thousands of glucose units, whereas hemicelluloses are polysaccharides consisting predominately of xylose in cellulose fibers derived from hardwoods and a combination of xylose, galactose, and mannose in cellulose fibers derived from softwoods. As used herein, the term "oxidation" means any process that converts hydroxyl groups of the cellulose (and hemicellulose portion) to carbonyl groups (such as aldehyde groups or ketone groups) and/or to carboxylic acid groups, thus increasing the amount of carbonyl and/or carboxyl groups over the amount present in the cellulose prior to oxidation. The oxidation of the cellulose may occur at any point after pulping, including before or after bleaching, or during one or more stages of the bleaching process.

Various methods of oxidizing cellulose are known. Depending on the oxidation method and conditions used, the type, degree, and location of the modifications may vary. According to the present invention, the method of oxidation may be any known method of cellulose oxidation that increases the amount of carbonyl and/or carboxyl groups over the amount present in the cellulose prior to oxidation. In some embodiments, the oxidation increases both the carbonyl content and the carboxyl content of the cellulose pulp over the amount present in the cellulose prior to oxidation. In some embodiments, the oxidation increases the carbonyl and/or carboxyl content of the cellulose pulp primarily at the $C_2$ and $C_3$ carbons of the cellulose monomers. In some embodiments, the oxidation increases the carbonyl and/or carboxyl content of the cellulose pulp primarily at the $C_6$ carbons of the cellulose monomers.

In some embodiments, the cellulose pulp is oxidized during one or more stages of a multi-stage bleaching sequence. In some embodiments, the cellulose is subject to acid prehydrolysis, followed by kraft pulping, followed by oxygen delignification, followed by a multi-stage bleaching process, wherein the cellulose is oxidized in at least one stage of the multi-stage bleaching process.

In some embodiments, the cellulose may be oxidized in either the second stage, third stage, or the fourth stage of a multi-stage bleaching sequence, for example, a three-stage, four-stage, or five-stage bleaching sequence. In some embodiments, the oxidation may be carried out in two or more stages of a multi-stage bleaching sequence. The non-oxidation stages of the multi-stage bleaching sequence may include any conventional or after discovered series of stages and may be conducted under conventional conditions.

In some embodiments, the oxidation of the cellulose may comprise treating the cellulose with at least one peroxide and at least one catalyst. In some embodiments, the oxidation of the cellulose may comprise treating the cellulose with at least a catalytic amount of a metal catalyst, for example, an iron or copper catalyst, and a peroxide, such as hydrogen peroxide. In some embodiments, the method comprises oxidizing the cellulose with an iron catalyst and hydrogen peroxide. The source of iron can be any suitable source, as a person of skill would recognize, for example, ferrous sulfate (for example ferrous sulfate heptahydrate), ferrous chloride, ferrous ammonium sulfate, ferric chloride, ferric ammonium sulfate, ferric ammonium citrate, or elemental iron. In some embodiments, the method comprises oxidizing the cellulose with a copper catalyst and hydrogen peroxide. Similarly, the source of copper can be any suitable source as a person of skill would recognize. In some embodiments, the method comprises oxidizing the cellulose with a combination of a copper catalyst and an iron catalyst and hydrogen peroxide.

In some embodiments, the method comprises oxidizing the cellulose at an acidic pH. In some embodiments, the method comprises providing the cellulose, acidifying the cellulose, and then oxidizing the cellulose at an acidic pH. In some embodiments, the method comprises oxidizing the cellulose with an iron and/or copper catalyst and a peroxide at an acidic pH. This method of oxidation increases the carbonyl and/or carboxyl content of the cellulose pulp primarily at the $C_2$ and $C_3$ carbons of the cellulose monomers. In some embodiments, the pH of the oxidation ranges from about 2 to about 6, for example, from about 2 to about 5, or from about 2 to about 4. In some embodiments, the method comprises oxidizing the cellulose with an iron catalyst and hydrogen peroxide at a pH from about 2 to about 5.

In some embodiments, the cellulose is not subjected to alkaline conditions during or after oxidation. Without wishing to be bound by theory, it is believed that subjecting cellulose that has been oxidized with an iron and/or copper catalyst and a peroxide at an acidic pH to alkaline conditions during or after the oxidation results in the breaking of cellulose chains where dialdehyde or other similar groups may have been imparted by the oxidation (particularly where dialdehydes have been formed at the $C_2$ and $C_3$ carbons). In some embodiments, the cellulose is subjected to a multi-stage bleaching process wherein each bleaching stage following the oxidation stage is an acidic bleaching stage (wherein a Dn bleaching stage is considered an acidic bleaching stage). In some embodiments, the cellulose is subjected to a multi-stage bleaching process wherein every stage of the multi-stage bleaching process is an acidic bleaching stage (wherein a Dn bleaching stage is considered an acidic bleaching stage).

In some embodiments, the cellulose is subjected to alkaline conditions during or after oxidation in order to cause a reduction in the viscosity and/or degree of polymerization of the oxidized cellulose. In some embodiments, at least one alkaline bleaching stage follows the at least one oxidation stage. In some embodiments, at least one alkaline bleaching stage and at least one acidic bleaching stage follows the at least one oxidation stage.

In some embodiments, the method of oxidizing the cellulose may involve acidifying a kraft pulp to a pH ranging from about 2 to about 5 (for example using sulfuric acid), mixing a source of iron (for example ferrous sulfate or ferrous sulfate heptahydrate) with the acidified kraft pulp at an application of from about 5 to about 200 ppm $Fe^{+2}$ based on the dry weight of the kraft pulp and adding hydrogen peroxide in an amount ranging from about 0.01% to about 0.3% based on the dry weight of the kraft pulp. In some embodiments, a ferrous sulfate solution is mixed with the kraft pulp at a consistency ranging from about 1% to about 15%, for example, from about 7% to about 15%. In some embodiments the acidic kraft pulp is mixed with the iron source and reacted with the hydrogen peroxide for a time period ranging from about 40 to about 240 minutes, for example, from about 60 to 120 minutes. In some embodiments the acidic kraft pulp is mixed with the iron source and reacted with the hydrogen peroxide at a temperature ranging from about 60 to about 90° C., for example, from about 60 to about 80° C.

In some embodiments, wherein the oxidation is carried out with a catalytic amount of a metal catalyst, such as an iron or copper catalyst, and a peroxide, such as hydrogen peroxide, an acidic step, such as an acidic bleaching step, may follow oxidation, which acidic step has been found to remove much, if not all, of the residual metal catalyst. In some embodiments, where the oxidation is conducted during at least one stage of a multi-stage bleaching process, at least one acidic bleaching step follows the at least one oxidation step. In some embodiments, the at least one additional acidic bleaching step is an acidic bleaching step comprising treatment with chlorine dioxide. In some embodiments where an acidic step follows the catalytic oxidation step, the resultant oxidized cellulose may have an iron and copper content of less than 10 ppm each, for example, less than 5 ppm each, wherein iron and copper content is determined by acid digestion and analysis by ICP.

In some embodiments, the cellulose is subject to acid prehydrolysis, followed by kraft pulping, followed by oxygen delignification, followed by a multi-stage bleaching process, wherein the cellulose is oxidized in at least one stage of the multi-stage bleaching process, and wherein at least one acidic bleaching step and at least one alkaline bleaching step follow the at least one oxidation bleaching step. In some embodiments, the cellulose is subject to acid prehydrolysis, followed by kraft pulping, followed by oxygen delignification, followed by a multi-stage bleaching process, wherein the cellulose is oxidized in at least one stage of the multi-stage bleaching process, and wherein every stage of the multi-stage bleaching process is an acidic bleaching stage (wherein a Dn bleaching stage is considered an acidic bleaching stage).

In some embodiments, the oxidized cellulose may be further treated with a carboxylating agent that converts aldehyde functional groups formed by the oxidation to carboxyl functional groups. In some embodiments, the carboxylating agent may be a carboxylating acid, for example, chlorous acid, acidic potassium dichromate, and/or potassium permanganate. In some embodiments, the treatment of the oxidized cellulose with a carboxylating agent may involve treating the oxidized cellulose in a "carboxylating treatment" stage comprising addition of sodium chlorite and hydrogen peroxide or chlorine dioxide and hydrogen peroxide. In some embodiments, the method comprises treating the oxidized cellulose with sodium chlorite and hydrogen peroxide. In some embodiments, the method comprises treating the oxidized cellulose with chlorine dioxide and hydrogen peroxide.

In some embodiments, the cellulose may be treated with a carboxylating agent after oxidation. In some embodiments, the cellulose may be treated with a carboxylating agent prior to oxidation. In some embodiments, the cellulose may be treated with a carboxylating agent both prior to and after oxidation.

In some embodiments, the oxidized cellulose may be treated with a carboxylating agent in one or more stages of a multi-stage bleaching sequence, for example a three-stage, four-stage, or five-stage bleaching process. In some embodiments, the cellulose is subject to acid prehydrolysis, followed by kraft pulping, followed by oxygen delignification, followed by a multi-stage bleaching process, wherein the cellulose is oxidized in at least one stage of the multi-stage bleaching process, and wherein the cellulose is treated with a carboxylating agent in at least one stage of the multi-stage bleaching process following the at least one oxidation stage.

By way of example, the cellulose pulp may be subject to one or more of the following bleaching sequences according to the present invention, wherein "D" refers to a bleaching stage comprising chlorine dioxide, where subscripts "0" and "1" indicate that the conditions within each stage may optionally be the same or different from one another; wherein "E" refers to an alkaline extraction stage chosen from one of an E, $E_O$, $E_P$, or $E_{OP}$ bleaching stage (where "$E_O$" represents an alkaline extraction stage comprising treatment with oxygen, "$E_P$" represents an alkaline extraction stage comprising treatment with a peroxide, and "$E_{OP}$" represents an alkaline extraction stage comprising treatment with oxygen and a peroxide); and wherein "OX" refers to an oxidation stage: $D_0(OX)D_1$, DE(OX), D(OX)E, $D_0E(OX)D_1$, $D_0(OX)ED_1$, $D_0(OX)D_1E$, $D_0ED_1(OX)$, $D_0(OX)D_1(OX)$, $D_0(OX)D_1D_2$, $D_0(OX)D_1ED_2$, $D_0ED_1(OX)D_2$, $D_0(OX)D_1(OX)D_2$, or $D_0D_1(OX)E$. In any of the preceding or following examples, one or more of the "D" stages may instead be a "Dn" stage comprising treatment with chlorine dioxide at an acidic pH followed by addition of NaOH to an alkaline pH prior to washing, for example $D_0(OX)DnD_1$. In any of the preceding or following examples, one or more of the "D" stages may instead be a carboxylating treatment (C/A) stage comprising treatment with sodium chlorite and hydrogen peroxide or chlorine dioxide and hydrogen peroxide, for example $D_0(OX)(C/A)D_1$, $D_0(OX)E(C/A)$, or $D_0(OX)Dn(C/A)$. In any of the preceding or following examples, one or more of the "E" stages may instead be a reducing "B" stage comprising treatment with a reducing agent, for example $D_0(OX)D_1B$, $D_0(OX)DnB$, $D_0D_1(OX)B$, or $D_0(OX)BD_1$. In some embodiments, one or more cold caustic extraction stages may follow as an additional stage in any of the preceding or following examples. In some embodiments, one or more acid sour stages may follow as an additional stage in any of the preceding or following examples. In some embodiments, both a cold caustic extraction stage and an acid sour stage may follow as additional stages in any of the preceding or following examples.

In some embodiments, the multi-stage bleaching sequence may be $D_0(OX)ED_1$, wherein neither of the D stages are carboxylating treatment or Dn stages, wherein the OX stage comprises oxidation with an iron catalyst and hydrogen peroxide at an acidic pH, and wherein the E stage is an alkaline extraction stage without use of added oxygen or peroxide (i.e., not an $E_O$, $E_P$, or $E_{OP}$ stage).

In some embodiments, the multi-stage bleaching sequence may be $D_0(OX)ED_1$, wherein neither of the D stages are carboxylating treatment or Dn stages, wherein the OX stage comprises oxidation with an iron catalyst and hydrogen peroxide at an acidic pH, and wherein the E stage is an alkaline extraction stage including the use of either added oxygen or peroxide, or both (i.e., is an $E_O$, $E_P$, or $E_{OP}$ stage). In some embodiments, the multi-stage bleaching sequence may be $D_0(OX)EopD_1$, wherein neither of the D stages are carboxylating treatment or Dn stages, and wherein the OX stage comprises oxidation with an iron catalyst and hydrogen peroxide at an acidic pH.

In some embodiments, the multi-stage bleaching sequence may be $D_0(OX)DnD_1$, wherein neither of the $D_0$ or $D_1$ stages are carboxylating treatment stages and wherein the OX stage comprises oxidation with an iron catalyst and hydrogen peroxide at an acidic pH. It has surprisingly been found that cellulosic pulps bleached according to this sequence may comprise post color number values of less than about 0.5 after aging 4 hrs at 105° C., for example, less than about 0.35, such as from about 0.3 to about 0.4. It has further surprisingly been found that cellulosic pulps bleached according to this sequence may comprise filterability values higher than about 2000 g/min, for example, higher than about 2500 g/min, higher than about 3000 g/min, or higher than about 3500 g/min, such as from about 2000 g/min to about 5000 g/min or from about 2500 to about 4500 g/min. It has further surprisingly been found that cellulosic pulps bleached according to this sequence may comprise clogging (Kr) values lower than about 1000, for example, lower than about 800, lower than about 600, or lower than about 400, such as from about 150 to about 800. These properties are unexpected and it has heretofore been unknown that such a dissolving kraft pulp could be made by a process comprising a multi-stage bleaching sequence without an alkaline extraction (E) stage.

In some embodiments, the D stage(s) of the bleaching sequence may be carried out at a temperature of at least about 74° C., for example, at least about 77° C., for example, at least about 79° C., for example, or at least about 82° C. and at a pH of less than about 4, for example, less than 3.5, for example, less than 3.2. Chlorine dioxide may be applied in an amount of from about 0.1 to 5% based on the dry weight of the pulp, for example, from about 0.1 to about 1%, from about 0.5% to about 1.5%, from about 1.5% to about 2.5%, or from about 2.5% to about 5%. Caustic may be applied to the cellulose in an amount effective to adjust to the desired pH, for example, in an amount of less than about 0.02% based on the dry weight of the pulp, for example, less than about 0.01%. In some embodiments, where there is more than one D stage, the amount of chlorine dioxide utilized in the first $D_0$ stage may be greater than the amount of chlorine dioxide utilized in the second $D_1$ stage. In some embodiments, the amount of chlorine dioxide utilized in the first $D_0$ stage may be less than the amount of chlorine dioxide utilized in the second $D_1$ stage.

In some embodiments, the $D_0$ stage may be conducted to a target viscosity of from about 15 to about 19 mPa·s at the end of the $D_0$ stage, for example from about 17 to about 18 mPa·s. Viscosity is measured according to TAPPI T230-om99. In some embodiments having a $D_0$ stage, the $D_0$ stage may be conducted to a target kappa number of from about 0.1 to about 4, for example, from to less than about 4, less than about 2, less than about 1.5, less than about 1, or less than about 0.5. Kappa number is determined according to TAPPI T236 cm-85 and may be used as an approximation for the amount of residual lignin in the pulp. In some embodiments having $D_0$ stage, the Do stage may be conducted to a target brightness of from about 68 to about 70 at the end of the $D_0$ stage. Brightness is measured according to TAPPI T525-om02. In some embodiments having $D_0$ stage, the $D_0$ stage may be conducted to a target viscosity of from about 15 to about 19 mPa·s, to a target kappa number of from about 3 to about 4, and to a target brightness of from about 68 to about 70 at the end of the $D_0$ stage.

In some embodiments, wherein one or more of the D stages is a carboxylating treatment stage, the carboxylating treatment may be carried out for a time and at a temperature that is sufficient to produce the desired completion of the reaction, for example, to achieve the desired carboxyl functionality of the final cellulose product. In some embodiments, the carboxylating treatment may be carried out at a temperature of at least about 55° C., at least about 65° C., or at least about 80° C., for example, from about 55° C. to about 80° C., and for a time period ranging from about 15 to about 150 minutes, for example, from about 15 to about 60 minutes, or from about 120 to 150 minutes, and at a pH of less than 3, for example, about 2.5. Sodium chlorite or chlorine dioxide at a concentration from about 0.1 to about 3% by weight based on the dry weight of the pulp can be used to generate chlorous acid, for example, from about 0.1 to about 2% or from about 0.1 to about 1. Hydrogen peroxide may be added in an amount from about 0.1 to about 2% by weight based on the dry weight of the pulp, for example, from about 0.1 to about 0.6%. In some embodiments, where there is more than one carboxylating treatment stage, the amount of carboxylating acid and hydrogen peroxide utilized in the first carboxylating treatment stage may be greater than the amount of carboxylating acid and hydrogen peroxide utilized in the second carboxylating treatment stage. In some embodiments, the amount of carboxylating acid and hydrogen peroxide utilized in the first carboxylating treatment stage may be less than the amount of carboxylating acid and hydrogen peroxide utilized in the second carboxylating treatment stage.

In some embodiments having an E stage, the E stage may be carried out at a temperature of at least about 74° C., for example, at least about 77° C., for example, at least about 79° C., for example, at least about 82° C., and at a pH of greater than about 11, for example, greater than 11.2, for example, about 11.4. Caustic, for example sodium hydroxide, may be applied in an amount of greater than about 0.7% based on the dry weight of the pulp, for example, greater than about 0.8%, greater than about 1.0%, or greater than about 1.5%. If the E stage is an $E_O$ or $E_{OP}$ stage, oxygen may be applied to the cellulose in an amount of at least about 0.48% based on the dry weight of the pulp, for example, at least about 0.5%, or at least about 0.53%. If the E stage is an $E_P$ or $E_{OP}$ stage, hydrogen peroxide may be applied to the cellulose in an amount of at least about 0.35% based on the dry weight of the pulp, for example, at least about 0.4%, or at least about 0.45%. The skilled artisan would recognize that any known peroxygen compound could be used to replace some or all of the hydrogen peroxide.

In some embodiments, the at least one oxidation (OX) stage may be carried out at a temperature ranging from about 60 to about 90° C., for example, from about 60 to about 80° C., and at a pH ranging from about 2 to about 5, for example, from about 2 to about 3.5. An iron catalyst may be added in an amount of from about 5 to about 200 ppm $Fe^{+2}$ based on the dry weight of the pulp, for example, from about 5 to about 100 ppm $Fe^{+2}$, from about 20 to about 50 ppm $Fe^{+2}$, or from about 25 to about 40 ppm $Fe^{+2}$. Hydrogen peroxide may be added in an amount from about 0.01% to about 1% by weight based on the dry weight of the pulp, for example, from about 0.01% to about 0.5%, from about 0.01% to about 0.3%, from about 0.05% to about 0.25%, or from about 0.08% to about 0.15%. In some embodiments, any known peroxygen compound could be used to replace some or all of the hydrogen peroxide. In some embodiments, where there is more than one oxidation stage, the amount of catalyst and hydrogen peroxide utilized in the first oxidation stage may be greater than the amount of catalyst and hydrogen peroxide utilized in the second oxidation stage. In some embodiments, the amount of catalyst and hydrogen peroxide utilized in the first oxidation stage may be less than the amount of catalyst and hydrogen peroxide utilized in the second oxidation stage.

In some embodiments, the at least one oxidation stage may be carried out to a target viscosity of from about 0.5 to about 2 mpa·s higher than the target viscosity at the end of the multi-stage bleaching process, for example, from about 0.75 to about 1.5 mpa·s higher. In some embodiments, the at least one oxidation stage may be carried out to a target viscosity of from about 8 mpa·s to about 9 mpa·s, or from about 6 mpa·s to about 7.5 mpa·s.

In some embodiments having a Dn stage, the Dn stage may comprise addition of chlorine dioxide in an amount of from about 0.1 to 5% based on the dry weight of the pulp, for example, from about 0.1 to about 1%, from about 0.5% to about 1.5%, from about 1.5% to about 2.5%, or from about 2.5% to about 5%. The Dn stage reaction with chlorine dioxide may be conducted at a pH in the range of from about 2 to about 5, for example, from about 3 to about 4. The Dn stage further comprises the addition of caustic, for example NaOH, at the end of the Dn stage before the washer, for example in the dilution zone of the reactor or in-line between the reactor and the washer. The caustic may be added in an amount effective to adjust to the desired pH, for example, in an amount of from about 5 to about 12 lbs/ton based on the dry weight of the pulp, for example, about 7 to about 10 lbs/ton. In some embodiments having a Dn stage, the caustic may be added in an amount to raise the pH of the cellulose before the washer to from about 8 to about 12, for example from about 8.5 to about 11.

In some embodiments having a B stage, the B stage may comprise addition of a reducing agent that converts aldehyde and/or carboxylic acid groups to hydroxyl groups, including those at the $C_2$ and $C_3$ carbons. The reduction reaction of the cellulosic material may occur at any point during production of the cellulosic pulp that follows at least one oxidation step. In some embodiments, the multi-stage bleaching process comprises at least one oxidation bleaching stage and at least one reduction bleaching stage following the oxidation stage. In some embodiments the reduction reaction may follow the multi-stage bleaching sequence in a separate step.

Without being bound by theory, it is believed that treating oxidized cellulose with a reducing agent increases the stability of the oxidized cellulose, thereby improving brightness and/or color reversion. By reducing aldehydes back to hydroxyl groups, the reduction treatment further creates additional reactive sites for cellulose derivatives and cellulose dissolution, and prevents those aldehyde groups from further oxidation into carboxylic acid groups, which may be unreactive in cellulose derivatizations. Thus, including of at least one reducing B stage following the at least oxidation stage is believed to unexpectedly further increase reactivity, filtration, and clogging factor of the resulting cellulosic pulp.

The reducing agent may be selected from one or more of lithium tetrahydridoaluminate(III) (also known as lithium aluminum hydride), sodium tetrahydridoborate(III) (also known as sodium borohydride), sodium cyanoborohydride, 9-BBN-pyridine, tributyltin hydride, diisobutylaluminium hydride, L-selectride, diborane, diazene, aluminum hydride, and the like. The reaction may further take place with our without a catalyst, for example a metal catalyst. In some embodiments, sodium borohydride may be used as the reducing agent. In some embodiments, lithium aluminum hydride may be used as the reducing agent. In some embodiments, diborane may be used as the reducing agent. The reduction reaction may be conducted at a neutral to alkaline pH.

In some embodiments, the oxidized pulp may be treated with a reducing agent in the B stage in an amount of from about 0.1% to about 1% based on the dry weight of the cellulosic pulp, for example, from about 0.2% to about 0.8% or from about 0.25% to about 0.5%. In some embodiments, the reduction reaction may be carried out in a B stage at a pH ranging from about 6 to about 14, for example, from about 8 to about 13 or from about 10 to about 12. In some embodiments, the reduction reaction may be carried out in a B stage for a time period ranging from 5 to about 90 minutes, for example from about 30 to about 60 minutes, and at a temperature ranging from about 60 to about 80° C., for example about 70° C.

In some embodiments, a hypochlorite stage ("H") may also be included, either before, after, or as a step within the multi-step bleaching process. In some embodiments, an H stage is not included.

In some embodiments, a cold caustic extraction stage may also be included, comprising treatment of the cellulose pulp with NaOH at a temperature of from about 25° C. to about 40° C. Such a cold caustic extraction stage may be incorporated either before, after, or as a step within the multi-step bleaching process. In some embodiments, a cold caustic extraction is not included.

Many dissolving pulp applications require a low mineral (metal ion) content. Accordingly, soft water may be used in any of the processes described herein where water is used in order to minimize introduction of minerals, for example calcium or silica. In the United States, soft water is classified as having less than 60 mg/l of calcium carbonate. In some embodiments, an acid sour stage may also be included, either before, after, or as a step within the multi-step bleaching process in order to remove minerals. In some embodiments, soft water and/or an acid sour stage may be used in order to control the calcium content of the dissolving pulp to less than about 200 ppm, for example, less than about 150 ppm, less than about 125 ppm, less than about 100 ppm, or less than about 50 ppm. In some embodiments, soft water and/or an acid sour stage may be used in order to control the silica content of the dissolving pulp to less than about 150 ppm, for example, less than about 100 ppm, or less than about 75 ppm. Mineral content may be measured by acid digestion and analysis by ICP.

In some embodiments, the dissolving pulp may have an ISO brightness at the end of bleaching of at least about 80%, such as at least about 83%, or at least about 85%, for example, ranging from about 83% to about 90%, or from about 86% to about 90%, for example from about 88% to about 90%. In some embodiments, the final ISO brightness may be achieved without the use of optical brightening agents. In some embodiments, at least one optical brightening agent can be added to further increase the ISO brightness of the bleached pulp to an amount of at least about 92%. Optical brightening agents are typically disfavored in dissolving pulps. Therefore, in preferred embodiments, an optical brightening agent is not included.

In some embodiments, the bleaching process may be conducted under conditions to target a final viscosity. Viscosity is measured according to TAPPI T230-cm99. In some embodiments, the dissolving pulp may have a viscosity at the end of bleaching of less than about 8.0 mPa·s, less than about 7.0 mPa·s, less than about 6.0 mPa·s, or less than about 5.0 mPa·s, for example, ranging from about 3.0 mPa·s to about 8.0 mPa·s, or from about 4 mPa·s to about 7.5 mPa·s, or from about 5.5 mPa·s to about 6.5 mPa·s, or from about 6.5 mPa·s to about 7.5 mPa·s.

In some embodiments, the bleaching process may be conducted under conditions to target a final carboxyl content. Carboxyl content is measured according to TAPPI T237-cm98. In some embodiments, the dissolving pulp may have a carboxyl content at the end of bleaching of at least about 1 meq/100 g, for example, from about 1 meq/100 g to about 5 meq/100 g, or from about 2 meq/100 g to about 4 meq/100 g. In sequences comprising a carboxylating acid stage, the carboxyl content may range from about 4 meq/100 g to about 12 meq/100 g, for example, from about 6 meq/100 g to about 10 meq/100 g.

In some embodiments, the bleaching process may be conducted under conditions to target a final copper number. Copper number is measured according to TAPPI T430-cm99 and is believed to relate to the quantity of carbonyl groups on the cellulose. In some embodiments, the dissolving pulp may have a copper number at the end of bleaching of greater than about 0.2, for example, ranging from about 0.2 to about 2, from about 0.5 to 1.5, or from about 0.7 to about 1. In sequences comprising a reducing B stage, the copper number may be less than about 0.5, for example less than about 0.2.

In some embodiments, the dissolving pulp may have a carbonyl content at the end of bleaching of at least about 0.2 meq/100 g, for example, ranging from about 0.2 to 3.2, from about 0.7 to 2.4, or from about 1.1 to about 1.6. Carbonyl content is calculated from Copper Number according to the formula: carbonyl=(Cu. No.−0.07)/0.6, from Biomacromolecules 2002, 3, 969-975.

In some embodiments, the dissolving pulp may have an aldehyde content at the end of bleaching ranging from about 0.2 meq/100 g to about 3 meq/100 g, for example, from about 0.5 meq/100 g to about 1.5 meq/100 g. Aldehyde content is measured according to Econotech Services LTD, procedure ESM 055B.

R18 represents the residual amount of undissolved material left after extraction of the pulp with an 18% caustic solution and is measured according to TAPPI T235-cm00. R18 may be used as an approximation for residual hemicellulose content in softwood fibers. While higher R18 values correlate to a higher alpha cellulose contents (and thus lower hemicellulose contents), higher R18 values also correspond to lower yield and greater cost. In some embodiments, the dissolving pulp may be a high-purity pulp having an R18 at the end of bleaching of greater than about 96%. In some embodiments, the dissolving pulp may be a medium-purity pulp having an R18 at the end of bleaching ranging from 90% to about 95%, for example, from about 93% to about 95%, or from about 90% to about 93%.

R10 represents the residual amount of undissolved material left after extraction of the pulp with a 10% caustic solution and is measured according to TAPPI T235-cm00. Generally, in a 10% caustic solution, hemicellulose and chemically degraded short chain cellulose are dissolved and removed in solution. In some embodiments, the dissolving pulp may be a high-purity pulp having an R10 at the end of bleaching of greater than about 93%. In some embodiments, the dissolving pulp may be a medium-purity pulp having an R10 at the end of bleaching ranging from 85% to 93%, for example, from about 87% to about 92%, from about 87% to about 90%, or from about 90% to about 93%. In some embodiments where the viscosity ranges from about 6.5 mPa·s to about 7.5 mPa·s, the R10 may range from about 90% to about 93%. In some embodiments where the viscosity ranges from about 4 mPa·s to about 6.5 mPa·s, the R10 may range from about 87% to about 90%.

ΔR represents the difference between the R18 and R10 values (ΔR=R18−R10), and may be used to approximate the amount of chemically degraded short chained cellulose that is present in the cellulose. In some embodiments, the dissolving pulp may have a ΔR at the end of bleaching ranging from about 3% to about 4%

In some embodiments dissolving pulp may have a pentosans level at the end of bleaching ranging from about 1% to about 8%, for example, from about 2% to about 5%, or from about 3% to about 4%. The pentosans level may be measured by Tappi T223 cm-10.

In some embodiments, the dissolving pulp may have an R10 of from about 87% to about 90%, a viscosity of from 4 mPa·s to 6.5 mPa·s, a clogging value (Kr) of less than about 600, and an ISO brightness of at least about 88. In some embodiments, the dissolving pulp may have an R10 of from about 90% to about 92%, a viscosity of from 6.5 mPa·s to 7.5 mPa·s, a clogging value (Kr) of less than about 1000, and an ISO brightness of at least about 88.

The cellulose pulp may be either used directly as dissolving pulp in suitable dissolving pulp applications or formed into sheets, bales, or rolls for storage and later use as dissolving pulp. Any suitable papermaking processes may be used to transform the cellulose pulp into sheets, bales, or rolls.

In some embodiments, the cellulose pulp can be treated with a surfactant before being used as dissolving pulp. The surfactant for use in the present invention may be solid or liquid. The surfactant can be any surfactant, including but not limited to softeners, debonders, and surfactants that are not substantive to the fiber, i.e., which do not interfere with its specific absorption rate. As used herein a surfactant that is "not substantive" to the fiber is one that increases the specific absorption rate of the cellulose pulp by 30% or less as measured using the PFI test as described herein. In some embodiments, the specific absorption rate is increased by 25% or less, for example 20% or less, 15% or less, or 10% or less. Not wishing to be bound by theory, the addition of surfactant causes competition for the same sites on the cellulose as the test fluid. Thus, when a surfactant is too substantive, it reacts at too many sites reducing the absorption capability, reactivity, and/or filterability of the fiber.

As used herein, PFI absorption is measured according to SCAN-C-33:80 Test Standard, Scandinavian Pulp, Paper and Board Testing Committee. The method is as follows: First, the sample is prepared using a PFI Pad Former. Turn on the vacuum and feed approximately 3.01 g cellulose pulp into the pad former inlet. Turn off the vacuum, remove the test piece and place it on a balance to check the pad mass. Adjust the mass to 3.00±0.01 g and record as $Mass_{dry}$. Place the cellulose into the test cylinder. Place the cellulose containing cylinder in the shallow perforated dish of an Absorption Tester and turn the water valve on. Gently apply a 500 g load to the cellulose pad while lifting the test piece cylinder and promptly press the start button. The Tester will run for 30 s before the display will read 00.00. When the display reads 20 seconds, record the dry pad height to the nearest 0.5 mm ($Height_{dry}$). When the display again reads 00.00, press the start button again to prompt the tray to automatically raise the water and then record the time display (absorption time, T). The Tester will continue to run for 30 seconds. The water tray will automatically lower and the time will run for another 30 seconds. When the display reads 20 s, record the wet pad height to the nearest 0.5 mm ($Height_{wet}$). Remove the sample holder, transfer the wet pad to the balance for measurement of $Mass_{wet}$ and shut off the water valve. Specific Absorption Rate (s/g) is $T/Mass_{dry}$. Specific Capacity (g/g) is $(Mass_{wet}-Mass_{dry})/Mass_{dry}$. Wet Bulk (cc/g) is $[19.64\ cm^2 \times Height_{wet}/3]/10$. Dry Bulk is $[19.64\ cm^2 \times Height_{dry}/3]/10$. The reference standard for comparison with the surfactant treated fiber is an identical fiber without the addition of surfactant.

Suitable surfactants include cationic surfactants, anionic, and nonionic surfactants that are not substantive to the fiber. In some embodiments, the surfactant is a non-ionic surfactant. In some embodiments, the surfactant is a cationic surfactant. It has long been thought that cationic materials should not be used as pulp pre-treatments for dissolving pulps used in the production of viscose. Not wishing to be bound by theory it is believed that the dissolving pulps produced according to the present invention differ from prior art dissolving pulps in their form, character and chemistry, largely due to the oxidation process, which increases the carbonyl content and/or carboxyl content. As such, cationic surfactants are not binding in the same manner as they did with prior dissolving pulps that had not undergone oxidation. The dissolving pulps according to the present invention, therefore, are believed to unexpectedly separate in a way that improves caustic penetration and filterability when treated with a cationic surfactant.

It is generally recognized that surfactants are often available commercially only as complex mixtures rather than as single compounds. While the following discussion will focus on the predominant species, it should be understood that commercially available mixtures would generally be used in practice. In some embodiments, the surfactant may be a vegetable based surfactant, such as a vegetable based fatty acid, such as a vegetable based fatty acid quaternary ammonium salt. Such compounds include DB999 and DB1009, both available from Cellulose Solutions. DB999 comprises a cationic fatty acid quaternary ammonium salt. Other suitable surfactants may include, but are not limited to, Berol Visco® 388 a polyoxyl ethylene glycol derivative from Akzo Nobel. In some embodiments, the surfactant excludes nonylphenol products.

In some embodiments, the surfactant may be biodegradable. Representative biodegradable cationic surfactants are disclosed in U.S. Pat. Nos. 5,312,522; 5,415,737; 5,262,007; 5,264,082; and 5,223,096. For example, the compounds may be biodegradable diesters of quaternary ammonia compounds, quaternized amine-esters, and biodegradable vegetable oil based esters functional with quaternary ammonium chloride and diester dierucyldimethyl ammonium chloride.

The surfactant may be added in an amount of up to 8 lbs/ton based on the dry weight of the dissolving pulp, such as from about 2 lbs/ton to about 7 lbs/ton, such as from about 4 lbs/ton to about 6 lbs/ton.

The surfactant may be added at any point following bleaching. Where the cellulose pulp is formed into rolls, bales, or sheets, the surfactant may be added at any point following bleaching and before formation of the rolls, bales, or sheets. In some embodiments, the surfactant may be added by spraying or brushing following the formation of a cellulose sheet. In some embodiments, the surfactant may be added just prior to the headbox of a pulp machine. It is believed that this method of incorporation leads to more uniform distribution of the surfactant onto the pulp fibers than when applied after sheet formation.

The dissolving pulps according to the present invention may be incorporated into any product known to derive from dissolving pulps. In some embodiments, the dissolving pulps may be used as a partial or complete replacement for the use of traditional dissolving pulps. In some embodiments, the dissolving pulps according to the present invention may be included in the final product in an amount of at least about 5% of the total weight of the cellulose in the final product, for example, at least about 10%, at least about 20%, at least about 50%, at least about 75%, or 100%.

In some embodiments the dissolving pulps can be used in the production of viscose products, for example, Viscose Staple Fibers, Viscose Films (e.g., Cellophane®), and Viscose Filament Yarn (e.g., Continuous Spun Yarn). To prepare viscose, dissolving pulp are typically treated with aqueous sodium hydroxide to form "alkali cellulose." The alkali cellulose is then treated with carbon disulfide to form sodium cellulose xanthate. The xanthate is dissolved in aqueous sodium hydroxide to form a viscose solution and allowed to depolymerize to a desired extent (ripen). Viscose fiber is produced from the ripened solutions by treatment with a mineral acid, such as sulfuric acid. In this step, the xanthate groups are hydrolyzed to regenerate cellulose and release dithiocarbonic acid that later decomposes to carbon disulfide and water. The thread made from the regenerated cellulose is washed to remove residual acid. The sulfur is then removed by the addition of sodium sulfide solution and impurities are oxidized by bleaching with sodium hypochlorite solution.

In some embodiments, the dissolving pulp according to the present invention may have a filterability in a viscose solution of from about 500 grams/min to about 5000 grams/min, for example, at least about 1000 grams/min, at least about 2000 grams/min, or at least about 2500 grams/min. Filterability may be measured by The Determination of Viscose Filterability of Slurry Steeped Wood Pulp J-25A. In that test, the pulp is slurry steeped in 18% caustic. The slurry is pressed to form an alkali cellulose cake at a press weight ratio resulting in 2.7 times the original mass of the pulp. The alkali cellulose is shredded and then aged to a target ball fall viscosity, which is measured by The Determination of Viscose Viscosity J-14. Where the time in seconds of a ⅛" stainless steel to drop 20 cm at 20° C. is recorded and multiplied by 1.494 to calculate the viscosity in poise. When the target ball fall viscosity is satisfactory, the viscose dope is measured for its filterability using the method Filtration Value of Viscose J-24, where the filtration value or filterability of the viscose is reported as the total number of grams of the viscose which can be filtered through 0.25 square inches (1.60 square centimeters) of the specified type of filter media consisting of 4 oz. per square yard type AA filter cotton batting covered on each side with 48/48 count unbleached cotton sheeting, using 60 psi pressure on the viscose.

In some embodiments, the dissolving pulp according to the present invention may have a clogging factor (Kr) in a viscose solution of less than about 1500, for example, less than about 1200, less than about 1000, less than about 800, less than about 500, or less than about 300, for example, from about 100 to about 1000 or from about 200 to about 800. Clogging factor (also known as clogging value or "Kr") may be measured by the procedure in Strunk, Peter, "Characterization of cellulose pulps and the influence of their properties on the process and production of viscose and cellulose ethers [verkkodokumentti]" Umeå: Umeå University, 52 s, 2012 (pp. 65-66) ISBN 978-91-7459-406-5.

Carbon disulfide reactivity is another attribute that may be used to evaluate the performance of dissolving wood pulps. Carbon disulfide reactivity may be measured by Chinese National Standard test: FZ/T 50010.13-2011. In that test, the difference in time (ΔT) for a dope treated with a given dosage of carbon disulfide to flow from 25-50 mL and from 125-150 mL is evaluated. For each dosage of carbon disulfide, a pass in the test is defined as having a ΔT of less than 250 seconds. In some embodiments, the dissolving pulp according to the present invention may have a carbon disulfide reactivity of ΔT less than 250 seconds at 11 ml carbon disulfide, for example, less than 50 seconds at 11 ml carbon disulfide, or less than 10 second at 11 ml carbon disulfide for 14.4 g of oven dried pulp. In some embodiments, the dissolving pulp according to the present invention may have a carbon disulfide reactivity of ΔT less than 250 seconds at 9 ml carbon disulfide, for example, less than 50 seconds at 9 ml carbon disulfide, or less than 10 seconds at 9 ml carbon disulfide for 14.4 g of oven dried pulp. In some embodiments, the dissolving pulp according to the present invention may have a carbon disulfide reactivity of ΔT less than 250 seconds at 7 ml carbon disulfide, for example, less than 50 seconds at 7 ml carbon disulfide, or less than 10 seconds at 7 ml carbon disulfide for 14.4 g of oven dried pulp.

Without being bound by theory, it is believed that the combination of acid prehydrolysis and oxidation in accordance with embodiments of the present invention leads to an increase in at least one of filterability, clogging value, and/or carbon disulfide reactivity at a given R10 value and viscosity, as compared to other softwood kraft dissolving pulps made without both acid prehydrolysis and oxidation. Surprisingly, these pulps may also be made with a high ISO brightness.

In some embodiments, the dissolving pulp according to the present invention may have a titer of from about 1.5 to about 2.5 dtex, for example, from about 2.0 to about 2.2 dtex. In some embodiments, the dissolving pulp according to the present invention may have an elongation of from about 10% to about 20%, for example, from about 14% to about 16%. In some embodiments, the dissolving pulp according to the present invention may have a tenacity of from about 10 to about 25 cN/tex, for example, from about 15 to about 20 cN/tex. Titer, elongation, and tenacity, may be measured using VIBRODYN 500 and VIBROSKOP 500 instruments from Lenzing.

In some embodiments the dissolving pulps can be used in the production other regenerated cellulosic materials such as rayon, lyocell, and the like. In some embodiments, the dissolving pulps can be used in the production of chemically reacted cellulose derivatives such as cellulose ethers, cellulose esters, cellulose acetates, nitrocelluloses, cellulose casings, tire cord, and the like.

As used herein, "about" is meant to account for variations due to experimental error. All measurements are understood to be modified by the word "about", whether or not "about" is explicitly recited, unless specifically stated otherwise.

The details of one or more non-limiting embodiments of the invention are set forth in the examples below. Other embodiments of the invention should be apparent to those of ordinary skill in the art after consideration of the present disclosure.

Example 1

A mill trial was conducted to manufacture three samples of dissolving pulp according to the present disclosure. In each, southern softwood pine cellulose was subjected to acidic steam prehydrolysis in batch digesters. The severity of the conditions was varied, as measured by the calculated time/temperature factor in Pr units reported in Table 1. The cellulose was then subjected to kraft cooking. The degree of kraft cooking was varied, as measured by the calculated time/temperature factor in H units reported in Table 1. The brownstock kraft pulp was next de-knotted and screened and then further delignified in a two stage oxygen delignification system.

The kraft pulp was next bleached in a four-stage bleaching plant with the sequence $D_0(OX)ED_1$. A solution of ferrous sulfate heptahydrate (FeSO4.7H2O) was added to the repulper of the $D_0$ stage vacuum washer for use in the oxidation (OX) stage. Hydrogen peroxide was then added to the washed Do-stage pulp already containing the ferrous sulfate as the pulp entered the oxidation (OX) stage, with the rate adjusted to achieve a viscosity target of 5-8 mPa·s after this stage. NaOH was added in the E stage to achieve a target pH at the E stage washer of about 11 as measured in the washer. Following bleaching, the kraft pulp was formed into sheets on a conventional pulp dryer incorporating a Fourdrinier wet end and drum dryers. Prior to the headbox of the pulp dryer, the surfactant DB999 was added to the stock line with a metering pump. Soft water was also added as make-up water to the bleached stock chest and the subsequent machine whitewater was used as wash water on the last bleaching stage washer to reduce the mineral content of the pulp. The finished product sheets were measured for the dissolving pulp compositional properties including purity (R18), viscosity, and mineral content.

A summary of the process parameters (Table 1) and resulting properties (Table 2) for each trial is shown below:

TABLE 1

| | Prehydrolysis Pr units | Pulping H units | OX pH | OX $Fe^{2+}$ ppm | OX $H_2O_2$ % | DB999 lbs/ton |
|---|---|---|---|---|---|---|
| Trial 1 | 4437 | 2317 | 3.5 | 50 | 0.1-0.15 | 2.8 |
| Trial 2 | 3689 | 2041 | 3.5 | 50 | 0.1-0.15 | 5.3 |
| Trial 3 | 3752 | 2314 | 3.5 | 50 | 0.1-0.15 | 4.3 |
| Trial 4 | 3814 | 2077 | 3.5 | 25-50 | 0.1-0.15 | 4.4 |

TABLE 2

| | R-18, % | Brightness % ISO | Viscosity mPa · s | Calcium ppm | Silica ppm | Filterability grams/min | Reactivity ΔT (s) @ 13 mL $CS_2$ |
|---|---|---|---|---|---|---|---|
| Trial 1 | 94.3 | 87.2 | 6.2 | 125 | 87 | na | 118 |
| Trial 2 | 92.7 | 86.0 | 5.6 | 124 | 87 | 618 | 15 |
| Trial 3 | 93.7 | 84.7 | 7.0 | 173 | 97 | 391 | 86 |
| Trial 4 | 93.8 | 83.3 | 6.9 | 172 | 78 | 1418 | 7 |

Example 2

A further mill trial was conducted to manufacture additional samples of dissolving pulp. In each, southern softwood pine cellulose was subjected to acidic steam prehydrolysis in batch digesters. The cellulose was then subjected to kraft cooking. The brownstock kraft pulp was next de-knotted and screened and then further delignified in a two stage oxygen delignification system.

The kraft pulp was next bleached in a multi-stage bleaching plant according to either a bleaching sequence of $D_0(OX)ED_1$ or $D_0(OX)DnD_1$ according to the present invention or a comparative bleaching sequence without an oxidation stage of $D_0EopD_1HD_2$.

Following bleaching, the kraft pulp was formed into sheets on a conventional pulp dryer incorporating a Fourdrinier wet end and drum dryers. Prior to the headbox of the pulp dryer, the surfactant DB999 was added to the stock line with a metering pump. Soft water was also added as make-up water to the bleached stock chest and the subsequent machine whitewater was used as wash water on the last bleaching stage washer to reduce the mineral content of the pulp. The finished product sheets were measured for compositional properties.

A summary of the process parameters (Table 3) and resulting properties (Tables 4 and 5) for each trial is shown below:

TABLE 3

| | $O_2$Delig NaOH lbs/ton | Pr units | H units | OX pH | OX $Fe^{2+}$ ppm | OX $H_2O_2$% | DB999 lbs/ton |
|---|---|---|---|---|---|---|---|
| $D_0EopD_1HD_2$ Samples | N/A | 7100 | 2300 | N/A | N/A | N/A | N/A |
| $D_0(OX)ED_1$ Samples | 45 | 3800 | 2200 | >4 | 30 | 1.0-0.15 | 3.6 |
| $D_0(OX)DnD_1$ Samples | 35 | 3800 | 2200 | >4 | 30 | 1.0-0.15 | 3.8 |

TABLE 4

| | $D_0EopD_1HD_2$ Sample 1 | $D_0(OX)ED_1$ Sample 1 | $D_0(OX)DnD_1$ Sample 1 |
|---|---|---|---|
| Viscosity | 6.68 | 5.98 | 6.98 |
| Brightness | 87.64 | 85.98 | 88.99 |
| L* | 96.98 | 96.64 | 97.32 |
| a* | −0.38 | −0.18 | −0.39 |
| b* | 3.8 | 4.46 | 3.36 |

TABLE 4-continued

| | $D_0EopD_1HD_2$ Sample 1 | $D_0(OX)ED_1$ Sample 1 | $D_0(OX)DnD_1$ Sample 1 |
|---|---|---|---|
| WI | 75.43 | 71.64 | 78.28 |
| YI | 6.79 | 8.16 | 5.96 |
| R10 | 94.81 | 91.13 | 91.19 |
| R18 | 96.41 | 93.34 | 93.49 |
| Reactivity, 7.5 mL CS2 | | Pass - ΔT 11 s | |
| Reactivity, 10 mL CS2 | Pass - ΔT 26 s | | |
| Reactivity, 11 mL CS2 | | | Pass - ΔT 4 s |
| Filterability (grams/min) | 2700 | 1950 | 2550 |
| Clogging (Kr) value | 3000 | 730 | 690 |
| Carbohydrates | | | |
| Arabinose, % | <0.01 | <0.01 | <0.01 |
| Galactose, % | 0.0624 | 0.132 | 0.121 |
| Glucose, % | 95.4 | 84.0 | 89.5 |
| Xylose, % | 2.24 | 2.97 | 3.07 |
| Mannose, % | 1.51 | 2.39 | 2.53 |
| Functional Groups | | | |
| Carboxyl, meq/100 g | 2.73 | 3.03 | 3.30 |
| Aldehyde, meq/100 g | 0.76 | 0.68 | 0.84 |
| Copper No., meq/100 g | 0.35 | 0.86 | 0.79 |
| Carbonyl, meq/100 g | 0.47 | 1.32 | 1.20 |
| Minerals | | | |
| Ca (ug/u), 422.673 nm | 40.4 | 89.7 | 133.0 |
| Cu (ug/u), 327.395 nm | 0.331 | <D.L. | 0.348 |

TABLE 4-continued

| | $D_0EopD_1HD_2$ Sample 1 | $D_0(OX)ED_1$ Sample 1 | $D_0(OX)DnD_1$ Sample 1 |
|---|---|---|---|
| Fe (ug/u), 238.204 nm | 1.73 | 2.70 | 3.13 |
| Mg (ug/u), 280.270 nm | 11.6 | 26.9 | 42.7 |
| Mn (ug/u), 259.372 nm | 0.105 | 0.124 | 0.125 |
| Na (ug/u), 589.592 nm | 453.0 | 505.0 | 509.0 |

TABLE 5

| | $D_0EopD_1HD_2$ Sample 2 | $D_0(OX)ED_1$ Sample 2 | $D_0(OX)DnD_1$ Sample 2 |
|---|---|---|---|
| Viscosity | 6.72 | 5.94 | 6.76 |
| Brightness | 87.19 | 85.81 | 89.22 |
| L* | 96.92 | 96.65 | 97.41 |
| a* | −0.41 | −0.16 | −0.36 |
| b* | 4.05 | 4.59 | 3.34 |
| WI | 74.16 | 71.03 | 78.59 |
| YI | 7.23 | 8.43 | 5.94 |
| R10 | 94.81 | 91.83 | 91.07 |
| R18 | 96.41 | 93.50 | 93.55 |
| Reactivity, 7.5 mL CS2 | | Pass - ΔT 11 s | |
| Reactivity, 10 mL CS2 | Pass - ΔT 26 s | | |
| Reactivity, 11 mL CS2 | | | Pass - ΔT 4 s |
| Filterability (grams/min) | 2700 | 1950 | 2550 |
| Clogging (Kr) value | 3000 | 730 | 690 |
| Carbohydrates | | | |
| Arabinose, % | <0.01 | <0.01 | <0.01 |
| Galactose, % | 0.0624 | 0.132 | 0.121 |
| Glucose, % | 95.4 | 84.0 | 89.5 |
| Xylose, % | 2.24 | 2.97 | 3.07 |
| Mannose, % | 1.51 | 2.39 | 2.53 |
| Functional Groups | | | |
| Carboxyl, meq/100 g | 2.73 | 3.03 | 3.30 |
| Aldehyde, meq/100 g | 0.76 | 0.68 | 0.84 |
| Copper No., meq/100 g | 0.35 | 0.86 | 0.79 |
| Carbonyl, meq/100 g | 0.47 | 1.32 | 1.20 |
| Minerals | | | |
| Ca (ug/u), 422.673 nm | 40.4 | 89.7 | 133.0 |
| Cu (ug/u), 327.395 nm | 0.331 | <D.L. | 0.348 |
| Fe (ug/u), 238.204 nm | 1.73 | 2.70 | 3.13 |
| Mg (ug/u), 280.270 nm | 11.6 | 26.9 | 42.7 |
| Mn (ug/u), 259.372 nm | 0.105 | 0.124 | 0.125 |
| Na (ug/u), 589.592 nm | 453.0 | 505.0 | 509.0 |

Example 3

The samples from Example 2 were next subjected to aging tests to evaluate viscosity, brightness reversion, and post color number. The samples in Table 4 were subjected to 4-hours of aging at 105° C., according to Tappi UM 200, and the results are shown in Table 6. The samples in Table 5 were subjected to 2-weeks of aging at 80° C., 65% RH, and the results are shown in Table 7.

TABLE 6

| | Viscosity | | Brightness | | b* value | | Post Color No. |
|---|---|---|---|---|---|---|---|
| Sample ID | Pre | Post | Pre | Post | Pre | Post | Post |
| $D_0EopD_1HD_2$ Sample 1 | 6.68 | 6.60 | 87.55 | 84.51 | 3.89 | 5.29 | 0.53 |
| $D_0(OX)ED_1$ Sample 1 | 5.98 | 5.88 | 85.78 | 83.57 | 4.51 | 5.51 | 0.44 |

TABLE 6-continued

| | Viscosity | | Brightness | | b* value | | Post Color No. |
|---|---|---|---|---|---|---|---|
| Sample ID | Pre | Post | Pre | Post | Pre | Post | Post |
| $D_0(OX)DnD_1$ Sample 1 | 6.98 | 6.49 | 89.11 | 86.84 | 3.38 | 4.47 | 0.33 |

TABLE 7

| | Viscosity | | Brightness | | b* value | | Post Color No. |
|---|---|---|---|---|---|---|---|
| Sample ID | Pre | Post | Pre | Post | Pre | Post | Post |
| $D_0EopD_1HD_2$ Sample 2 | 6.72 | 5.01 | 87.19 | 72.82 | 4.05 | 7.88 | 4.13 |
| $D_0(OX)ED_1$ Sample 2 | 5.94 | 4.85 | 85.81 | 71.53 | 4.59 | 7.96 | 4.49 |
| $D_0(OX)DnD_1$ Sample 2 | 6.76 | 5.15 | 89.22 | 73.38 | 3.34 | 7.21 | 4.18 |

Surprisingly, the Samples with the multi-stage bleaching sequences comprising at least one oxidation stage according to the present invention ($D_0(OX)ED_1$ or $D_0(OX)DnD_1$) demonstrated a comparable, and in some cases a superior, post color number after aging than the comparative samples made with the bleaching sequence without an oxidation stage ($D_0EopD_1HD_2$). Post color number was determined according to the method reported in W. H. Rapson and J. H. Spinner, The Bleaching of Pulp, 3rd Ed. (R. P. Singh, Ed.) Tappi Press, p. 358 (1979).

Example 4

A further mill trial was conducted to manufacture additional samples of dissolving pulp. In each, southern softwood pine cellulose was subjected to acidic steam prehydrolysis in batch digesters. The cellulose was then subjected to kraft cooking. The brownstock kraft pulp was next de-knotted and screened and then further delignified in a two stage oxygen delignification system.

The kraft pulp was next bleached in a multi-stage bleaching plant according to a $D_0(OX)DnD_1$ sequence. Following bleaching, the kraft pulp was formed into sheets on a conventional pulp dryer incorporating a Fourdrinier wet end and drum dryers. Prior to the headbox of the pulp dryer, the surfactant DB999 was added to the stock line with a metering pump. Soft water was also added as make-up water to the bleached stock chest and the subsequent machine whitewater was used as wash water on the last bleaching stage washer to reduce the mineral content of the pulp. The finished product sheets were measured for compositional properties.

The viscosity of each sample was adjusted by adjusting the strength of the oxidation bleaching stage to form $D_0(OX)$ DnD1 samples 3 through 8 in order to evaluate the relative effect on other properties. A summary of the resultant properties is shown in Table 8 below. Some properties were measured in two different labs and the average is reported.

TABLE 8

| | Sample 3* | Sample 4 | Sample 5 | Sample 6 | Sample 7 | Sample 8 |
|---|---|---|---|---|---|---|
| Viscosity, mPa · s (avg.) | 4.8 | 5.7 | 5.7 | 6.7 | 6.8 | 7.1 |
| Brightness % (avg.) | 89.9 | 89.1 | 88.9 | 89.4 | 87.7 | 89.4 |
| R18% (avg.) | 92.5 | 94.2 | 93.1 | 95 | 93.4 | 94.1 |
| R10% (avg.) | 88.0 | 89.3 | 89.2 | 92.0 | 90.7 | 91.3 |
| Reactivity, 11 ml CS2 | Pass - ΔT 1 s | Pass | Pass - ΔT 1 s | Pass - ΔT 1 s | Pass | Pass |
| Reactivity, 9 ml CS2 | Pass - ΔT 1 s | Pass | Pass - ΔT 0 s | Pass - ΔT 1 s | Pass | Pass |
| Reactivity, 7 ml CS2 | Pass - ΔT 1 s | Pass | Pass - ΔT 1 s | Pass - ΔT 50 s | Fail | Pass |
| Filterability g/min (avg.) | — | 2600 | 4465 | 1600 | 2013 | 1857 |
| Clogging (Kr) | — | 200 | 200 | 800 | 690 | 820 |
| Titer (dtex) | — | 2.9 | 2.6 | 2.6 | 2.5 | 2.6 |
| Elongation (%) | — | 18.6 | 17.6 | 13.1 | 13.1 | 15.5 |
| Tenacity (cN/tex) | — | 15 | 16.6 | 15.9 | 16.3 | 14.9 |

*Sample 3 was manufactured in a lab instead of in a mill.

What is claimed is:

1. A kraft dissolving wood pulp made from softwood comprising an R10 of from about 87% to about 92%, an R18 from about 93% to about 95%, a viscosity of from about 4 mPa·s to about 7.5 mPa·s, and a clogging value (Kr) from about 100 to about 1000.

2. The kraft dissolving wood pulp of claim 1, further comprising a pentosans level of from about 2% to about 5%.

3. The kraft dissolving wood pulp of claim 1, further comprising an ISO brightness of from about 86 to about 90.

4. The kraft dissolving wood pulp of claim 1, further comprising a carboxyl content of from about 2 meq/100 g to about 4 meq/100 g and a copper number from about 0.5 to about 1.5.

5. The kraft dissolving wood pulp of claim 1, further comprising a filterability of at least about 2000 grams/min and a carbon disulfide reactivity of ΔT less than 10 seconds at 9 ml carbon disulfide for 14.4 g of oven dried pulp.

6. The kraft dissolving wood pulp of claim 1, comprising an R10 of from about 87% to about 90%, a viscosity of from 5.5 mPa·s to 6.5 mPa·s, a clogging value (Kr) from about 100 to about 600, and an ISO brightness of at least about 88.

7. The kraft dissolving wood pulp of claim 1, comprising an R10 of from about 90% to about 92%, a viscosity of from 6.5 mPa·s to 7.5 mPa·s, a clogging value (Kr) from about 100 to about 800, and an ISO brightness of at least about 88.

* * * * *